US009011044B2

(12) United States Patent
Burns et al.

(10) Patent No.: US 9,011,044 B2
(45) Date of Patent: Apr. 21, 2015

(54) DRILLING RIG ICE PROTECTOR APPARATUS AND METHODS

(75) Inventors: Thomas A. Burns, Houston, TX (US); Michael J. Blythe, Salisbury Cove, ME (US); Alberto C. Morandi, Houston, TX (US)

(73) Assignee: American Global Maritime, Inc., Houston, TX (US)

( * ) Notice: Subject to any disclaimer, the term of this patent is extended or adjusted under 35 U.S.C. 154(b) by 262 days.

(21) Appl. No.: 12/777,941

(22) Filed: May 11, 2010

(65) Prior Publication Data

US 2010/0329796 A1 Dec. 30, 2010

Related U.S. Application Data

(60) Provisional application No. 61/177,190, filed on May 11, 2009.

(51) Int. Cl.

| | |
|---|---|
| ***E02D 31/00*** | (2006.01) |
| ***B63B 35/12*** | (2006.01) |
| ***E02B 17/00*** | (2006.01) |

(52) U.S. Cl.

CPC ..... *B63B 35/12* (2013.01); *B63B 2211/06* (2013.01); *E02B 17/0021* (2013.01); *E02B 17/003* (2013.01); *E02B 2017/006* (2013.01)

(58) Field of Classification Search

USPC ..... 405/211, 212, 213, 214, 215, 216, 217; 114/265, 219, 220

See application file for complete search history.

(56) References Cited

U.S. PATENT DOCUMENTS

| | | | | | |
|---|---|---|---|---|---|
| 3,672,175 | A | * | 6/1972 | Mason | 405/211 |
| 3,693,360 | A | * | 9/1972 | Holder | 405/211 |
| 3,793,840 | A | * | 2/1974 | Mott et al. | 405/211 |
| 4,040,265 | A | * | 8/1977 | Hellerman et al. | 405/196 |
| 4,048,943 | A | * | 9/1977 | Gerwick, Jr. | 114/256 |
| 4,063,428 | A | * | 12/1977 | Waas | 405/212 |
| 4,102,144 | A | * | 7/1978 | Anders | 405/211 |
| 4,215,756 | A | * | 8/1980 | Hunt | 180/127 |
| 4,215,952 | A | * | 8/1980 | Baardsen | 405/211 |
| 4,239,418 | A | * | 12/1980 | Pearce | 405/211 |

(Continued)

FOREIGN PATENT DOCUMENTS

JP 59-040992 A 3/1984

OTHER PUBLICATIONS

PCT International Search Report and Written Opinion for Application No. PCT/US2010/034368 mailed Jan. 28, 2011 (9 pages).

(Continued)

*Primary Examiner* — Doug Hutton, Jr.
*Assistant Examiner* — Patrick Lambe
(74) *Attorney, Agent, or Firm* — Osha Liang LLP

(57) ABSTRACT

A diversion assembly to protect a leg of an maritime structure from floating debris includes at least one upper inclined surface and at least one flotation element to buoy the diversion assembly around the leg of the maritime structure, wherein the at least one inclined surface is configured to divert floating debris away from the leg of the maritime structure. A method to protect an offshore platform from damage due to floating debris includes attaching a diversion assembly about the periphery of at least one leg of the offshore platform and diverting the floating debris away from the at least one leg of the offshore platform with at least one inclined surface.

22 Claims, 7 Drawing Sheets

(56) References Cited

U.S. PATENT DOCUMENTS

| | | | | | |
|---|---|---|---|---|---|
| 4,245,929 | A | * | 1/1981 | Pearce et al. | 405/211 |
| 4,325,655 | A | * | 4/1982 | Jahns et al. | 405/217 |
| 4,425,055 | A | * | 1/1984 | Tiedemann | 405/217 |
| 4,427,320 | A | * | 1/1984 | Bhula | 405/211 |
| 4,434,741 | A | * | 3/1984 | Wright et al. | 114/264 |
| 4,437,793 | A | * | 3/1984 | Meny et al. | 405/212 |
| 4,505,618 | A | * | 3/1985 | Yashima | 405/211 |
| 4,571,125 | A | * | 2/1986 | Oshima et al. | 405/224 |
| 4,578,000 | A | * | 3/1986 | Lindqvist et al. | 405/211 |
| 4,618,286 | A | * | 10/1986 | Michel et al. | 405/208 |
| 4,639,167 | A | * | 1/1987 | Petty et al. | 405/217 |
| 4,655,642 | A | * | 4/1987 | Birdy et al. | 405/217 |
| 4,662,790 | A | * | 5/1987 | Loire | 405/212 |
| 4,666,343 | A | * | 5/1987 | Butt et al. | 405/217 |
| 4,686,924 | A | * | 8/1987 | Poldervaart et al. | 405/212 |
| 4,695,194 | A | * | 9/1987 | Bhalaik et al. | 405/207 |
| 4,699,545 | A | * | 10/1987 | Chen et al. | 405/217 |
| 4,725,166 | A | * | 2/1988 | Bhalaik et al. | 405/217 |
| 4,738,566 | A | * | 4/1988 | Marthinsen | 405/217 |
| 4,784,526 | A | * | 11/1988 | Turner | 405/204 |
| 4,808,036 | A | * | 2/1989 | Bhalaik et al. | 405/217 |
| 4,963,058 | A | * | 10/1990 | Broughton et al. | 405/207 |
| 5,269,632 | A | * | 12/1993 | Pelletier et al. | 405/263 |
| 5,310,286 | A | * | 5/1994 | Gilbert et al. | 405/169 |
| 6,371,695 | B1 | * | 4/2002 | Davenport et al. | 405/204 |
| 6,371,696 | B1 | * | 4/2002 | Eathorne | 405/211 |
| 7,383,885 | B2 | * | 6/2008 | Bergeron et al. | 166/345 |
| 7,421,966 | B2 | * | 9/2008 | Boutaghou | 114/219 |
| 2006/0034668 | A1 | * | 2/2006 | Knezek et al. | 405/211 |
| 2006/0062638 | A1 | * | 3/2006 | Bergeron et al. | 405/211 |

OTHER PUBLICATIONS

Espacenet abstract for Publication No. 59040992 Publication date Mar. 6, 2984 (1 page).

PCT Notification of Transmittal, Preliminary Report and Written Opinion for Application No. PCT/US2010/034368 mailed Nov. 24, 2011 (6 pages).

* cited by examiner

DRILLING RIG ICE PROTECTOR APPARATUS AND METHODS

CROSS-REFERENCE TO RELATED APPLICATIONS

This application claims priority from Application 61/177,190, filed on May 11, 2009, in the United States.

BACKGROUND OF THE DISCLOSURE

1. Field of the Disclosure

Embodiments of the present disclosure relate to protection devices and methods to shield maritime structures from damage that may result from impact with floating debris.

2. Description of the Related Art

Major operating oil and gas companies are now developing exploratory programs to tap into such natural resources in Arctic (and other extreme low-temperature) regions such as the Chukchi and Beaufort Seas. The success and sustainability of such projects may depend on the successful management of risks to personnel and the environment and the deployment of proven and cost effective alternatives to minimize financial risk and maximize the financial return to investment.

Drilling operations are at the forefront of such effort and jack-up drilling rigs represent one flexible and attractive mobile drilling unit ("MODU") solution that may be adaptable to the extreme cold offshore environment. In contrast to a year-round, dedicated (new-build or converted) rig, an existing MODU may offer a proven and cost effective solution as it may be deployed in the summer to take advantage of the warmer Arctic climate and then transferred to other areas of the world during the winter months.

Recent studies indicate that while some current jack-up leg chord designs are strong enough to withstand an impact of several inches of ice, the bracing members of the jack-up platforms are generally not. While the risk of such damage may be reduced with an effective ice management plan, it is desirable to have system in place that may protect the legs against ice exposure as an added risk mitigation measure.

SUMMARY OF THE CLAIMED SUBJECT MATTER

In one aspect, embodiments disclosed herein relate to a diversion assembly to protect a leg of an maritime structure from floating debris, including at least one upper inclined surface, and at least one flotation element to buoy the diversion assembly around the leg of the maritime structure, wherein the at least one inclined surface is configured to divert floating debris away from the leg of the maritime structure.

In another aspect, embodiments disclosed herein relate to an offshore platform, including a plurality of legs extending from a working deck of the platform toward a sea floor and a diversion assembly coupled to at least one of the plurality of legs, wherein the diversion assembly includes at least one upper inclined surface, and at least one flotation element to buoy the diversion assembly around the leg of the offshore platform, wherein the at least one inclined surface is configured to divert floating debris away from the leg of the offshore platform.

In another aspect, embodiments disclosed herein relate to a method to protect an offshore platform from damage due to floating debris, including attaching a diversion assembly about the periphery of at least one leg of the offshore platform and diverting the floating debris away from the at least one leg of the offshore platform with at least one inclined surface.

BRIEF DESCRIPTION OF DRAWINGS

Features of the present disclosure will become more apparent from the following description in conjunction with the accompanying drawings.

DETAILED DESCRIPTION

Embodiments disclosed herein relate to a diversion assembly configured to protect the legs (or other structures) of offshore drilling rigs in the event of an impact with sheets of water-borne ice. Although embodiments disclosed herein are described in reference to jack-up rigs, those having ordinary skill in the art will appreciate that the embodiments disclosed herein may be applicable to any maritime structure including, but not limited to, various offshore moorings, piers, pilings, permanent platforms, semisubmersible platforms, drillships, tension-leg platforms, spar platforms, and the like. As such, the embodiments disclosed herein may also be applicable to sea-going vessels configured for purposes other than oilfield exploration and production without departing from the subject matter as claimed. Additionally, it is contemplated by the applicants that embodiments disclosed herein may also be useful and applicable in circumstances where various types of floating debris (including, but not limited to, ice flows) are to be diverted away from maritime structures. For example, embodiments disclosed herein may be useful in protecting maritime structures from trash flows, hydrilla, and/or seaweed flows in addition to ice flows.

A diversion assembly is proposed to protect maritime structures, including but not limited to jack-up leg members, with minimal impact on the operations of the maritime structure (e.g., rig deployment) and on the structural integrity of the maritime structure (e.g., the legs of the rig). A diversion assembly may comprise a ring having three or four identical modular segments (depending on the vessel class in question) which may form a protective ring around each jack-up leg. Alternatively, any number of modular segments may be provided without deviating from the scope of the present disclosure. Additionally, while a diversion assembly is depicted in the Figures and described below as a generally circular-shaped ring, it should be understood to those having ordinary skill that additional geometric configurations may be constructed without departing from the scope of the attached claims. The various components that make up an exemplary embodiment of one type of diversion assembly are illustrated in FIGS. 1-5 and keyed to the descriptions below.

Figure 1A:
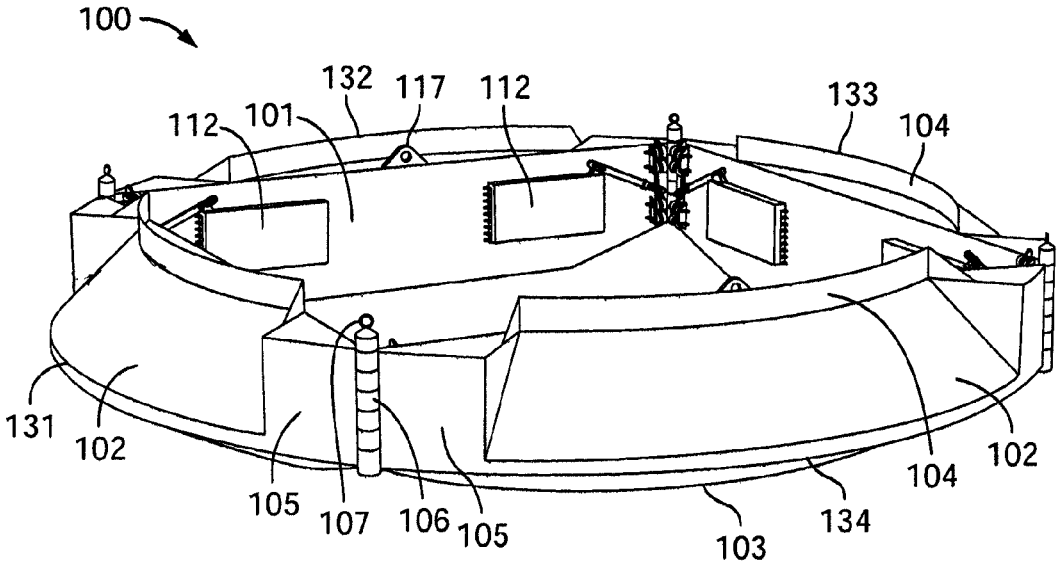
FIGS. 1A and 1B are schematics of a diversion assembly in accordance with one or more embodiments of the present disclosure.

Referring to FIG. 1A, a semi-circular diversion assembly 100 may include a number of segments, for example, segments 131, 132, 133, and 134. The structure of each segment 131, 132, 133, and 134 may include a central wedge-shaped section having an integral inner buoyant box 101. The outer wedge may be free-flooding, with an upper inclined surface 102 that may break up encountered ice and a lower inclined surface 103 that may reduce towing resistance and forces due to tidal currents. A vertical ice defector plate 104 may be located atop the upper inclined surface 102. The buoyant inner box 101 may provide buoyancy to keep the segments 131, 132, 133, and 134 afloat.

Strong boxes 105 may be provided at ends of the segments 131, 132, 133, and 134 to provide additional stiffness to connection points between segments 131, 132, 133, and 134. In certain embodiments, the connection points may be large hinged joints 106 that may have hinge rings attached in a staggered fashion to permit interleaving connection with an adjoining segment. In selected embodiments, the segments 131, 132, 133, and 134 may be fastened together by large removable steel hinge pins 107.

Additionally, a roller system may be located adjacent to the hinged points at each end of a segment. Each roller system may comprise two or more split horizontal rubber-coated rollers 108 and supports. An independently-rotating ratchet gear 109 may be attached to the rollers 108 at the center of each roller by a torsion spring (not shown).

A movable ratchet chock bar 111 may be located behind the rollers 108 at the ends of each segment. In certain embodiments, chock bar 111 may comprise a slender movable vertical member with a plurality of chock pins 110 attached corresponding to the ratchet gears 109 in each of the split roller assemblies 108. The chock bar 111 may be free to move in the vertical direction, but may be restrained horizontally by steel guides (not shown).

Adjacent to the rollers 108 at each end of the segments 131, 132, 133, and 134 may be a buoyant flotation box 112. Flotation box 112 may be free to move in the vertical direction, but may be restrained horizontally by steel guides and/or tracks 113. The lowest position to which flotation box 112 may slide may be limited by a stop plate or chock (not shown) fixed to the inner buoyant box 101 and located at the lower end of the track 113.

An actuating lever arm 114 comprised of a steel bar may be connected to both the flotation box 112 on one end, and the ratchet chock bar 111 on the other, by sliding pins 115. At a point between these two ends the lever arm 114 may be attached to fixed shell-mounted pivot pin 116 such that the lever arm 114 may be free to rotate about the pivot pin 116, and thus may act as a lever between the flotation box 112 and the ratchet chock bar 111. Pivot pin 116 may be rigidly attached to the inner buoyant box 101.

Lifting pad eyes 117 may be attached to and/or an integral part of each segment of the diversion assembly 100 that may enable an installed diversion assembly to be lifted clear of the water by cables and/or other mechanisms.

Figure 2:
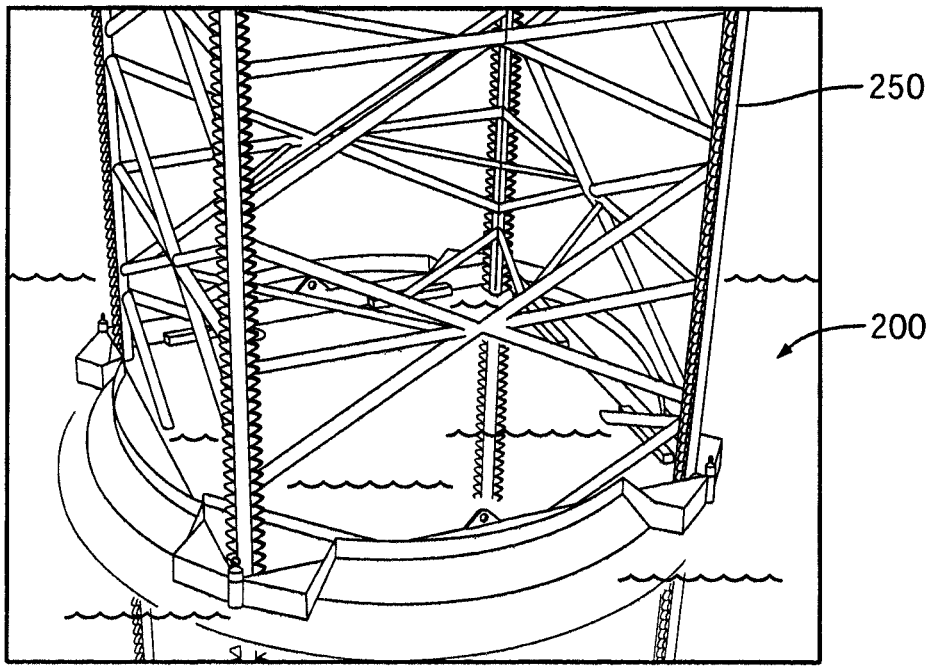
FIG. 2 is a schematic of a diversion assembly in accordance with one or more embodiments of the present disclosure as installed on a leg of a jack-up rig.
Figure 3:
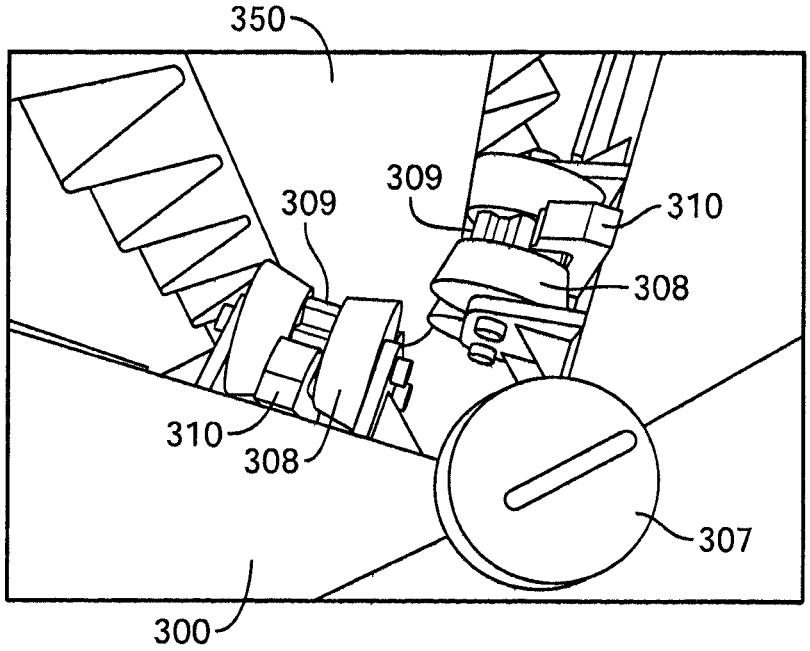
FIG. 3 is a close-up view of the installation of FIG. 2 in accordance with one or more embodiments of the present disclosure.

FIG. 2 is a schematic of a diversion assembly 200 in accordance with one or more embodiments of the present disclosure as installed on a leg 250 of a maritime structure, such as a jack-up rig. FIG. 3 is a close-up view of the installation of FIG. 2. Diversion assembly 300 is shown as attached to leg 350. A hinge pin 307 may join two segments of diversion assembly 300. A chock pin 310 may engage with a ratchet gear 309 thereby holding rollers 308 in place while in contact with leg 350.

Figure 4A:
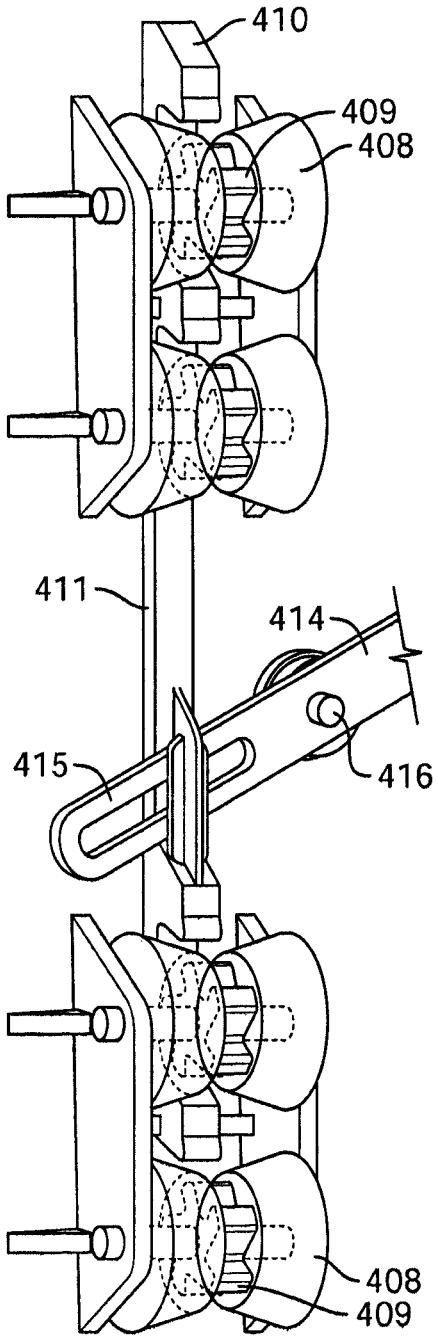
FIGS. 4A and 4B are schematic view drawings of a ratchet chock system in accordance with embodiments disclosed herein shown in a disengaged (4A) position and an engaged (4B) position.
Figure 4B:
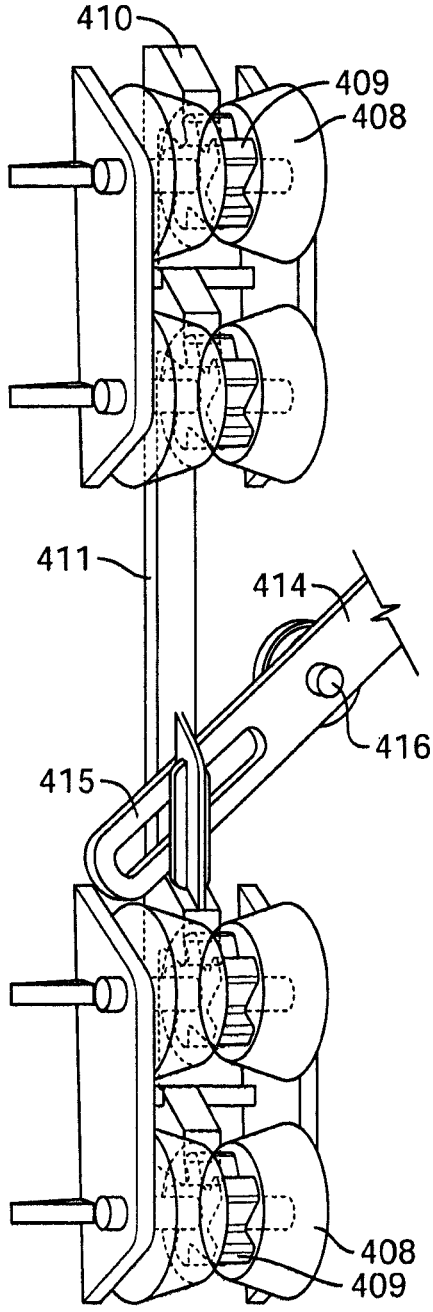

FIGS. 4A and 4B are schematic view drawings of a ratchet chock system in accordance with embodiments disclosed herein shown in a disengaged position (4A) and an engaged position (4B). Chock bar 411 may have chock pins 410 located at distal ends, and may be configured to engage with ratchet gears 409. Ratchet gears 409 may be configured to lock and/or hold rollers 408 in place, such that rollers 408 may engage with a leg of a maritime structure (see FIGS. 2 and 3). Further, chock bar 411 may be movably connected to a lever arm 414 by a sliding pin 415. The lever arm 414 and the sliding pin 415 may be rotatable about a pivot pin 416.

Figure 5:
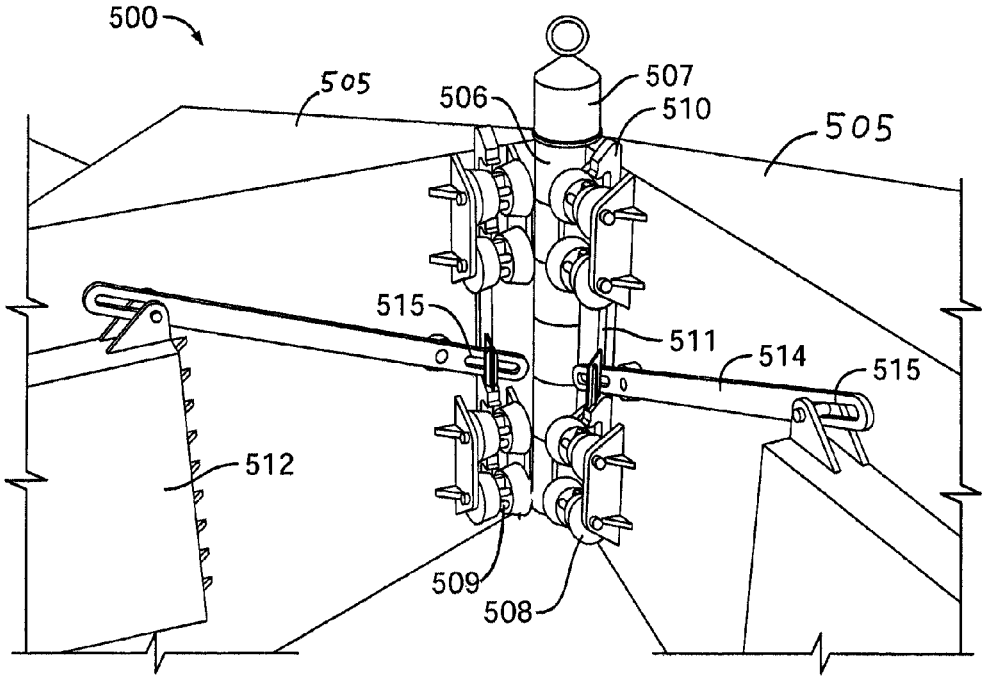
FIG. 5 is a close-up detailed rendering of a roller and chock system in accordance with embodiments disclosed herein.

Referring to FIG. 5, a schematic of the roller assembly is shown. Diversion assembly 500 may have strong boxes 505 adjacent to connecting points between two segments, which may be connected by hinged joints 506 and a hinge pin 507. Further, each segment may have flotation boxes 512. The flotation boxes 512 may be engaged with the roller assembly by sliding pins 515 and lever arms 514. Accordingly, a sliding pin 515 may engage with the flotation box 512 on one end of the lever arm 514, and another sliding pin 515 may engage with a chock bar 511. Chock bar 511 may have chock pins 510 that may engage with ratchet gears 509 and rollers 508.

Additionally, while various components described above are indicated as constructed from a particular kind or type of material (e.g., steel, rubber, etc.), it should be understood that the disclosed embodiments shall not be so limited. In particular, as marine environments are notoriously corrosive, various materials disclosed herein may be constructed to minimize galvanic cell and other types of corrosion. Furthermore, as various components are likely to be moveably connected to other components, certain wear-resistant materials may be employed. Finally, as buoyancy is used to "float" components of embodiments disclosed herein, certain light weight (e.g., aluminum, magnesium, titanium, etc) and/or buoyant (e.g., polymers, elastomers, etc) materials may also be used without departing from the scope of the claims listed below.

Based upon the embodiments described above, an exemplary procedure to install a diversion assembly as described above will be described with reference to FIGS. 6 and 7. Free-floating diversion assemblies 600 and 700 may be transported to installation locations of a drilling vessel (one for each leg) and may be installed around each leg once the drilling vessel has completed normal preload and is jacked up to its intended height above the water surface, or otherwise secured to the ocean floor.

For installation, one (or more) of the hinge pins 621 may be removed from each diversion assembly 600 to allow tugs (761 and 762 of FIG. 7) to "unfold" the diversion assembly about one or more of the remaining hinge points. Once the diversion assembly is open (see FIGS. 8-10), the tugs 761 and 762 may then maneuver the rollers on the still connected segments into contact with the leg (as shown in FIG. 3). Because the segments of the diversion assembly are buoyant, they may be tugged to an installation location in their partially or completely open state. The open ends of the ring may then be pulled closed and fastened together around the leg (or any other type of structure) by replacing the hinge pin(s) 621. This is then repeated for each of the remaining legs.

Once installed, each diversion assembly may remain free-floating in a vertical direction, but with motion in the horizontal plane restrained by rubber-coated rollers in contact with the outside profile of each leg, such as jack-up leg chords (as shown in FIG. 3). The rollers may allow the diversion assembly to move vertically in either direction in response to wave action and/or changes in water depth due to tidal changes. This arrangement provides a non-permanent attachment to the jack-up legs that may avoid the need for welded connections or straps that might otherwise damage the jack-up leg chords and braces.

Additionally, the vertical freedom of motion means that when a diversion assembly encounters an ice sheet, other debris flows, and/or other floating debris, the weight of the ice and/or other debris may tend to push the diversion assembly further into the water as the ice and/or other debris rides up on the upper inclined surface of the diversion assembly (see FIG. 1A). To counter this, the roller system may include a chocking mechanism (as described above) to prevent the diversion assembly from becoming too deeply immersed.

Behind the rollers at the ends of each diversion assembly segment module may be a vertically mounted ratchet chock bar which may be free to slide in the vertical direction. Integral to this bar may be a number of ratchet pins corresponding to a ratchet gear in each of the roller assemblies. Adjacent to the rollers, a buoyant flotation box may be attached which may be free to move vertically within a shell-mounted track in response to changes in the draft of the diversion assembly. The flotation box may be connected to the ratchet chock bar by a rotating lever arm (see FIGS. 4A, 4B, and 5).

Figure 1B:
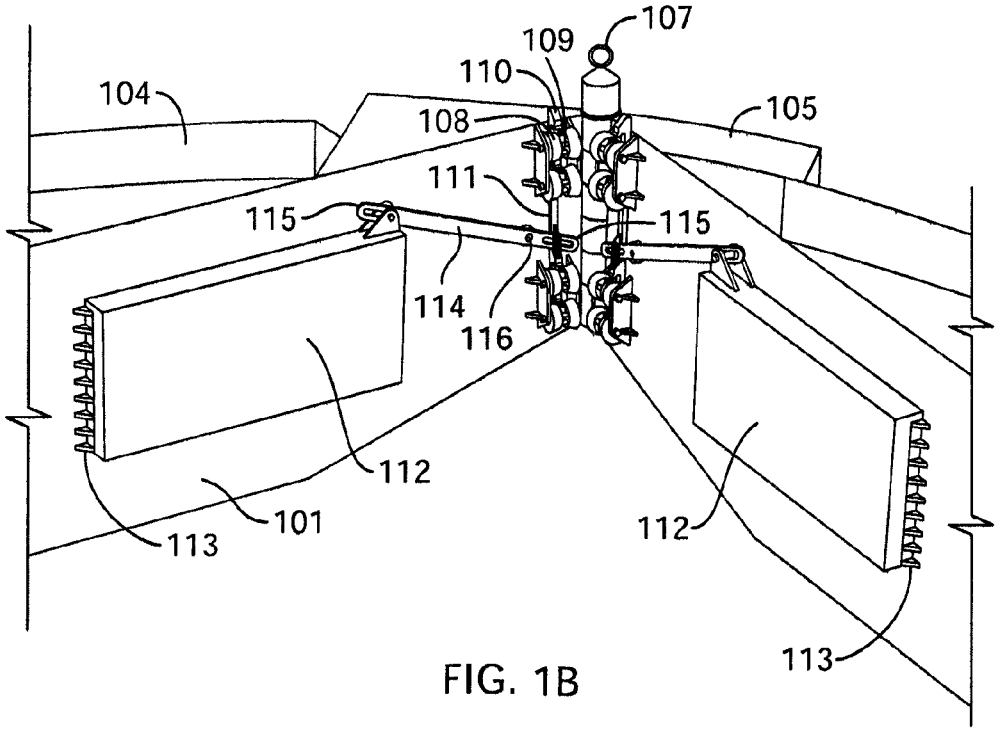

Whenever the diversion assembly may be submerged beyond an arbitrary limit draft, the flotation box may be pushed up along its track (see FIG. 1B). The flotation box may then pull up on the attached lever arm and force the lever bar to rotate about the pivot pin, which in turn may push the connected ratchet chock bar down. This may force the ratchet gears on the chock bar into the corresponding ratchet gear at the center of each roller. Once engaged by the ratchet gears, the chock bar may prevent the diversion assembly from becoming any further immersed and allow the diversion assembly to resist the force of the ice and/or other debris load.

After the ice and/or other debris pressure may be released, the process may work in reverse. The inherent buoyancy of the diversion assembly may apply an upward force on the diversion assembly, which may reduce the draft and lower the flotation box. This may in turn raise the chock bars clear of the ratchet gears and rollers. The ratchet gears may allow the rollers to easily disengage and begin rolling back up the leg.

Because the diversion assembly may normally be restrained only in the horizontal direction, the diversion assembly may be free to move up and down the outside edge of the leg chord as the diversion assembly responds to wave action. To prevent or reduce sudden impact loads on the rollers in the event the diversion assembly is temporarily immersed far enough to engage the chocks, each ratchet gear may be attached to its roller by means of a torsion spring. This may dampen the initial impact on the rollers (and by extension the rest of the diversion assembly) due to the chock being engaged suddenly while the diversion assembly is heaving up and down.

The diversion assembly may remain deployed in most conditions, even if ice is not an immediate possibility, and may be deployed and/or maintained in use to prevent impacts and/or interactions with other debris. However, in order to allow for the possibility of severe weather, it may be possible to lift each diversion assembly clear of the water. Two or more portable winches may be mounted at the edge of each leg well. Cables from these winches may be attached to opposing pad-eyes 117 at the top of the segments, as shown in FIG. 1A. In the event that the wave height exceeds safe operating limits for the diversion assembly in afloat mode, the winches may lift the diversion assemblies out of the water and retract them to a point just below the hull of the maritime structure.

In one exemplary embodiment, steel weight was estimated based on the arbitrary assumption of using 12.7 mm (½") plate for the ice contact surfaces, and 6.5 mm (¼") plate elsewhere, along with a very conservative margin. The buoyant volume used to maintain draft may be adjusted as necessary by increasing or decreasing the depth of the lower "current" slope area Additionally, the flotation boxes for the chock system may be tuned based on the final weight and motion characteristics of the diversion assembly.

Further, an alternative to using inclined contact surfaces may be to adopt a wall-sided approach and rely on merely deflecting the ice and/or other debris around the leg rather than breaking it up. While this may result in higher total horizontal loads on the leg, it may also eliminate the need for the roller chock system.

In the exemplary embodiments disclosed above, the diversion assembly is shown configured for a Letourneau 240C class vessel, but it should be understood that the design may be easily adapted to other rig and/or other maritime designs, including, for example, triangular three-chord legs like those of the KFELS Mod VIb.

Referring now to FIGS. 6-10, an exemplary procedure for installing a diversion assembly in accordance with one or more of the embodiments described above will be described. Although an exemplary procedure is disclosed, it should be understood that numerous variations may be performed, depending on a variety of factors including rig design, local regulations, and the location of installation.

Transport

The diversion assemblies may be transported on the same Heavy Lift Vessel (HLV) used to convey the rig or other maritime structure to a desired location, such as to the area of a drilling site. A number of diversion assemblies may be carried to the site corresponding to the number of legs employed by the structure to be protected, with each occupying a space on deck of approximately 20 m×20 m. The diversion assemblies may normally be transported with all three (triangular configuration) or four (square configuration) hinge pins fixed in place. However, it should be understood that when in transport (or when put in storage) the diversion assembly may be transported (or stored) with all hinge pins removed so that each segment of the diversion assembly may be completely disconnected form the remaining segments. Thus, the diversion assembly may be transported (or stored) in less space than in the assembled state.

Launch

Figure 6:
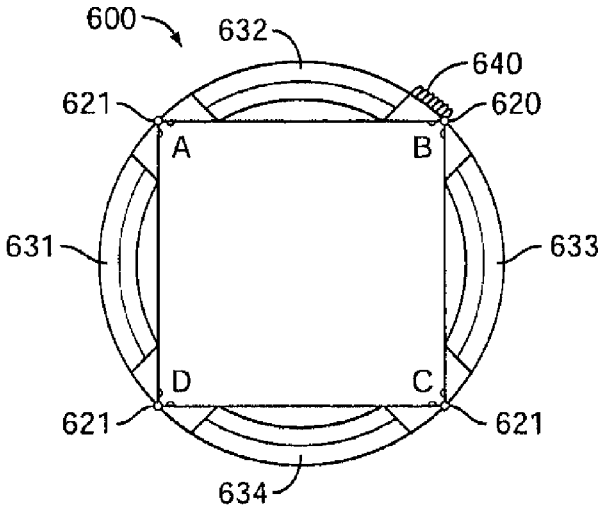
FIG. 6 is a schematic view drawing of a diversion assembly in accordance with embodiments disclosed herein prior to installation.
Figure 7:
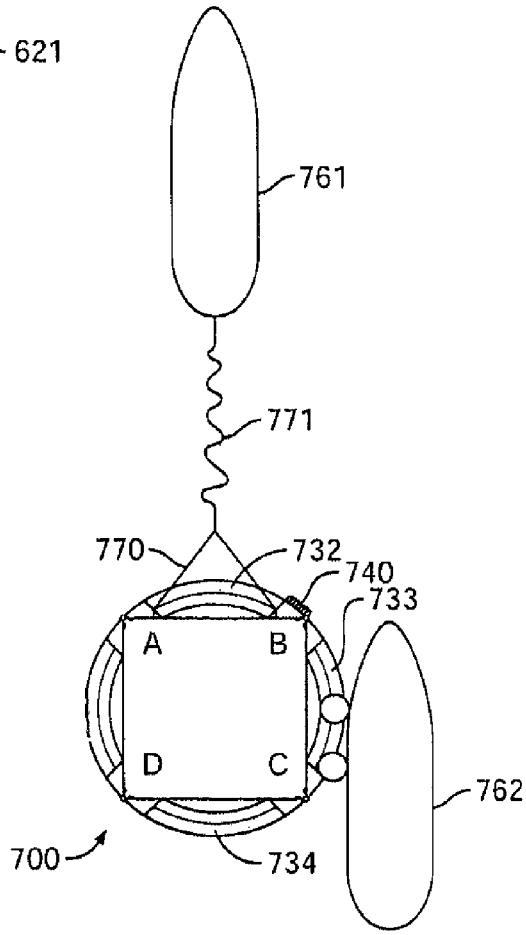
FIGS. 7, 8A, 8B, 9, and 10 depict a procedure to install the diversion assembly of FIG. 6 to a leg of a jack-up rig in accordance with embodiments disclosed herein.

Once the HLV is on location with a diversion assembly 600, hinge pins 621 may be installed on the outside edge of the segments 631, 632, 633, and 634 at hinge points (joints A, B, C, and D of FIG. 6). The hinge pins 621 may serve to keep joints A, B, C, and D closed in a fixed position during towage and/or installation, such as shown in FIGS. 6 and 7. The hinge pin at joint B may be removed 620 so that the segments 632 and 633 of the diversion assembly 600 may be "opened" for installation (as shown in FIG. 6). Further, a closing line 640 may be attached to segment 632 to enable control over the segment during installation.

Quick release pins (not shown) may be provided to attach temporarily to the outside of the segments. The quick release pins may be used to rigidly attach the hinges between segments such that the hinge may be prevented from swinging open or closed. Accordingly, the diversion assembly may be easier to install and/or handle. Quick release pins may be used between the segments of the diversion assembly that may not open during transportation, installation, and/or removal. The quick release pins may then be removed after installation.

Now, referring to FIG. 7, a transport and pre-installation of a diversion assembly 700 is shown. Prior to the launch, a 40 m length of 40 mm wire, closing line 740, may be flaked and attached to segment 732 by a pad eye and shackle at one end and held by quick release dips to the top deck of segment 732. The closing line 740 may have a hard eye at the bitter end for the purposes of safety compliance. Primary towing vessel 761 may be connected via a bridle 770 secured to segment 732 of diversion assembly 700 on a shortened tow line 771 (e.g., less than 600 m in length). The HLV may then be ballasted down into the water so that the diversion assembly 700 may float free.

Towage

As the diversion assembly 700 may come off the HLV's deck, the primary towing vessel 761 may ease forward until it is approximately one-half nautical mile from the HLV. This may allow a secondary towing vessel 762 to take segment 733 on its hip and secure its tow line to segment 734, as shown in FIG. 7. The group may then proceed, slowly, towards the drilling rig.

Installation

Figure 8A:
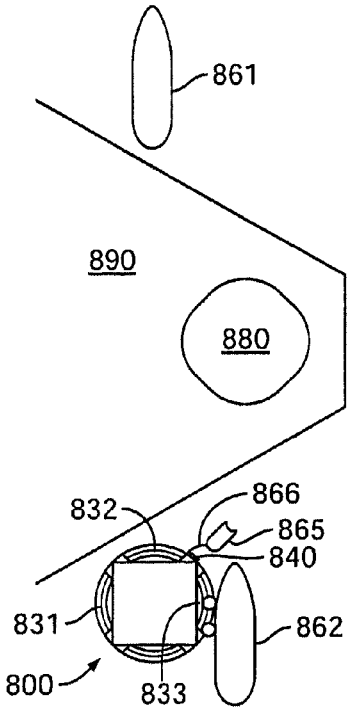
Figure 8B:
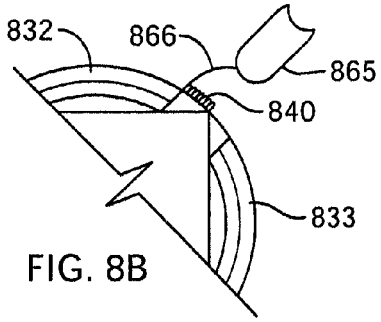
Figure 9:
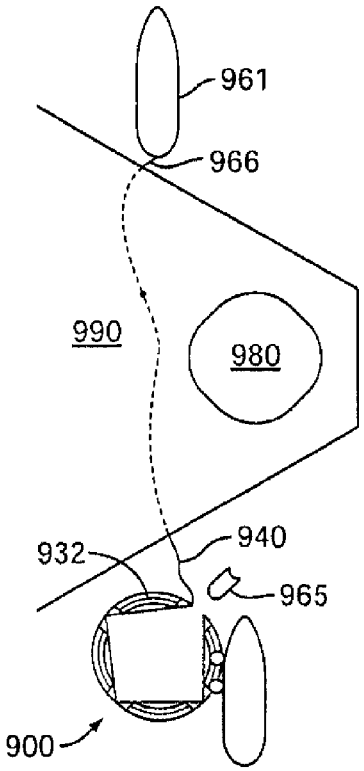
Figure 10:
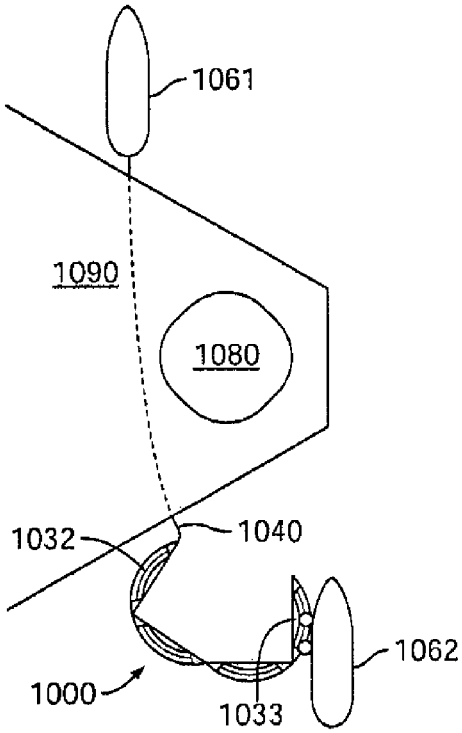

Referring to FIGS. 8-10, an installation process in accordance with one or more embodiments of the present disclosure will now be described. Upon arrival in the vicinity of the drilling rig 890 the primary towing vessel 861 may stop the tow, check with the rig to ensure that it may proceed further, and then confirm the actual height of the rig's air gap (i.e., the height of the rig's deck above the sea level). Primary towing vessel 861 may then recover its tow line and disconnect the bridle, moving to take segment 831 on its hip. Although not shown, primary towing vessel 861 would flank diversion assembly 800 at segment 831, similar to how secondary towing vessel 862 has segment 833 on its hip.

Referring to FIG. 8A, both primary and secondary towing vessels 861 and 862, respectively, may turn the diversion assembly 800 and approach the bow leg 880 of rig 890 from the starboard side of rig 890 with segment 832 facing the leg 880. At a distance of approximately 30 to 40 m off, the maneuver may stop and secondary towing vessel 862 may stay attached to diversion assembly 800 while primary towing vessel 861 may disconnect and pass around rig 890 such that it may be positioned stern to the leg 880 on the port side of rig 890. Primary towing vessel 861 may then put its work boat 865 into the water. The work boat 865 may attach a messenger line 866 to the hard eye of the closing line 840 flaked along segment 832, as shown in FIG. 8B. The work boat 865 may then pull the messenger line 866, with closing line 840 attached, under rig 890 abaft the leg 880. The work boat 865 may return to primary towing vessel 861 which may then heave in the messenger line 866.

Now, referring to FIG. 9, once the messenger line 966 and attached closing line 940 have been recovered to a winch drum of primary towing vessel 961, the work boat 965 may return to the diversion assembly 900 and remove the quick release pin at point B (as shown in FIGS. 6 and 7). This may allow the diversion assembly 900 to swing open slightly, as shown. Primary towing vessel 961 may then pull in closing line 940 so that segment 932 may be opened far enough such that diversion assembly 900 may fit around the forward jack-up leg 980 of rig 990.

Now, referring to FIG. 10, diversion assembly 1000 is shown in an open position such that a gap between segments 1032 and 1033 may be wide enough to wrap around jack-up leg 1080 of rig 1090. Both primary and secondary towing vessels 1061 and 1062, respectively, may then proceed to position the diversion assembly 1000 so that segments 1032 and 1033 may be secure alongside the facing sides of the leg 1080 and the rollers (as discussed above) about joint C are held against the intended leg chord. Secondary towing vessel 1062 may remain in position holding the diversion assembly 1000 in place while primary towing vessel 1061 may bring segment 1032 of diversion assembly 1000 across to engage with segment 1033 at joint B, thus closing diversion assembly 1000 and holding diversion assembly 1000 in place. The hinge pin at joint B may then be replaced to securely connect diversion assembly 1000 about jack-up leg 1080.

Secondary towing vessel 1062 may then disengage from segment 1033 and primary towing vessel 1061 may recover its tow line and secondary wire after the work boat 965 has disconnected the tow line from segment 1031. The above procedures may then be repeated on the remaining legs of the jack-up rig.

For jack-up rigs or other maritime structures having triangular legs, the legs may be approached in a similar manner but will have only three sections and require only one quick release pin. Preferably, this operation shall take place only in minimum sea/swell and light winds.

To remove a diversion assembly from a jack-up rig or other maritime structure, the above steps may be performed in reverse of the above description and should take place in similar sea/swell and wind conditions.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A diversion assembly to protect a leg of a maritime structure from floating debris, the diversion assembly comprising one or more segments, the one or more segments comprising:

at least one upper inclined surface, wherein an outer profile of the diversion assembly is maintained at a constant distance from the leg being protected;

a first flotation element to buoy the diversion assembly around the leg of the maritime structure; and a second flotation element to buoy the diversion assembly around the leg of the maritime structure, wherein the at least one upper inclined surface is configured to divert the floating debris away from the leg of the maritime structure, and wherein the first flotation element is movable with respect to the second flotation element in a first direction when the diversion assembly is coupled to a leg of a maritime structure, and wherein movement of the first flotation element with respect to the second flotation element is restricted in a second direction when the diversion assembly is coupled to a leg of a maritime structure.

2. The diversion assembly of claim 1, the one or more segments further comprising at least one ice deflector plate positioned above the at least one upper inclined surface.

3. The diversion assembly of claim 1, the one or more segments further comprising at least one lower inclined surface.

4. The diversion assembly of claim 1, wherein each segment is connected to an adjoining segment through a hinged joint.

5. The diversion assembly of claim 4, further comprising a plurality of removable hinge pins to selectively open and close the hinged joints to install and remove the diversion assembly about the leg of the maritime structure.

6. The diversion assembly of claim 1, further comprising a plurality of rollers to allow the diversion assembly to be vertically displaced relative to the leg of the maritime structure.

7. The diversion assembly of claim 1, further comprising at least one ratcheting chock bar to restrict vertical displacement of the diversion assembly relative to the leg of the maritime structure.

8. The diversion assembly of claim 7, wherein the second flotation element engages the at least one ratcheting chock bar to restrict vertical displacement of the diversion assembly relative to the leg of the maritime structure.

9. The diversion assembly of claim 8, wherein the second flotation element is connected to the at least one ratcheting chock bar by an actuating lever arm.

10. An offshore platform, comprising:

a plurality of legs extending from a working deck of the platform toward a sea floor;

a diversion assembly coupled to at least one of the plurality of legs, the diversion assembly comprising one or more segments, the one or more segments comprising:

at least one upper inclined surface, wherein an outer profile of the diversion assembly is maintained at a constant distance from the at least one of the plurality of legs being protected;

a first flotation element to buoy the diversion assembly around the leg of the offshore platform; and a second flotation element to buoy the diversion assembly around the leg of the offshore platform, wherein the at least one inclined surface is configured to divert floating debris away from the leg of the offshore platform, and wherein the first flotation element is movable with respect to the second flotation element in a first direction when the diversion assembly is coupled to the at least one of the plurality of legs of a maritime structure, and wherein movement of the first flotation element with respect to the second flotation element is restricted in a second direction when the diversion assembly is coupled to the at least one of the plurality of legs of a maritime structure.

11. The offshore platform of claim 10, further comprising at least one ice deflector plate positioned above the at least one upper inclined surface.

12. The offshore platform of claim 10, the one or more segments further comprising at least one lower inclined surface.

13. The offshore platform of claim 10, wherein each segment is connected to an adjoining segment through a hinged joint.

14. The offshore platform of claim 13, further comprising a plurality of removable hinge pins to selectively open and close the hinged joints to install and remove the diversion assembly about the leg of the offshore platform.

15. The offshore platform of claim 10, further comprising a plurality of rollers to allow the diversion assembly to be vertically displaced relative to the leg of the offshore platform.

16. The offshore platform of claim 10, further comprising at least one ratcheting chock bar to restrict vertical displacement of the diversion assembly relative to the leg of the offshore platform.

17. The offshore platform of claim 16, wherein the second flotation element engages the at least one ratcheting chock bar to restrict vertical displacement of the diversion assembly relative to the leg of the offshore platform.

18. The offshore platform of claim 17, wherein the second flotation element is connected to the at least one ratcheting chock bar by an actuating lever arm.

19. A method to protect an offshore platform from damage due to floating debris, the method comprising:

attaching a diversion assembly about a periphery of at least one leg of the offshore platform, wherein the diversion assembly comprises one or more segments, the one or more segments comprising:

at least one upper inclined surface, wherein an outer profile of the diversion assembly is maintained at a constant distance from the at least one leg being protected;

a first flotation element to buoy the diversion assembly around the at least one leg of the offshore platform; and a second flotation element to buoy the diversion assembly around the at least one leg of the offshore platform, wherein the first flotation element is movable with respect to the second flotation element in a first direction when the diversion assembly is attached about the periphery of the at least one leg of the offshore platform;

diverting the floating debris away from the at least one leg of the offshore platform with the at least one inclined surface; and restricting movement of the first flotation element with respect to the second flotation element in a second direction when the diversion assembly is attached about the periphery of the at least one leg of the offshore platform.

20. The method of claim 19, further comprising breaking up the floating debris with the at least one inclined surface.

21. A diversion assembly to protect a leg of a maritime structure from floating debris, the diversion assembly comprising one or more segments, the one or more segments comprising:

at least one lower inclined surface, wherein an outer profile of the diversion assembly is maintained at a constant distance from the leg being protected;

a first flotation element to buoy the diversion assembly around the leg of the maritime structure; and a second flotation element to buoy the diversion assembly around the leg of the maritime structure, wherein the at least one lower inclined surface is configured to divert the floating debris away from the leg of the maritime structure, and wherein the first flotation element is movable with respect to the second flotation element in a first direction when the diversion assembly is coupled to a leg of a maritime structure, and wherein movement of the first flotation element with respect to the second flotation element is restricted in a second direction when the diversion assembly is coupled to a leg of a maritime structure.

22. The diversion assembly of claim 21, the one or more segments further comprising at least one upper inclined surface.

* * * * *